United States Patent [19]

Nauheimer

[11] 4,402,404

[45] Sep. 6, 1983

[54] INSERT FOR GARMENT BOX

[75] Inventor: James F. Nauheimer, Chicago, Ill.

[73] Assignee: Container Corporation of America, Chicago, Ill.

[21] Appl. No.: 383,563

[22] Filed: Jun. 1, 1982

[51] Int. Cl.[3] ..... B65D 85/18

[52] U.S. Cl. ..... 206/279

[58] Field of Search ..... 206/278, 278.1, 279, 206/288, 289; 229/34 HW

[56] References Cited

U.S. PATENT DOCUMENTS

| | | | |
|---|---|---|---|
| 2,685,962 | 8/1954 | Druth | 206/279 |
| 4,060,169 | 11/1977 | Hildebrand | 206/289 |
| 4,119,197 | 10/1978 | Pilz | 206/279 |
| 4,300,687 | 11/1981 | Gardner | 206/279 |
| 4,318,472 | 3/1982 | Nauheimer | 206/289 |
| 4,342,389 | 8/1982 | Bethune | 206/288 |

*Primary Examiner*—Herbert F. Ross

*Attorney, Agent, or Firm*—Richard W. Carpenter; Davis Chin

[57] ABSTRACT

A one-piece paperboard insert for use within an outer shipping container including a central section interconnecting a pair of hollow end sections adapted to receive hook portions of garment hangers.

3 Claims, 4 Drawing Figures

INSERT FOR GARMENT BOX

BACKGROUND OF THE INVENTION

1. Field of the Invention

This invention relates generally to garment boxes, and more particularly to a paperboard insert intended for use within an outer shipping container and adapted to receive hook portions of garment hangers.

2. Description of the Prior Art

A prior art search directed to the subject matter of this application in the United States Patent and Trademark Office disclosed the following U.S. Pat. Nos. 1,662,819; 1,843,547; 3,003,616; 3,057,482; 3,220,632; 3,259,229; 3,823,684; 4,060,169; 4,085,842; 4,089,411; 4,158,406.

None of the prior art patents uncovered in the search disclosed a collapsible one-piece paperboard insert having a center tray section interconnecting a pair of hollow end sections adapted to receive hook portions of garment hangers.

SUMMARY OF THE INVENTION

It is an object of the present invention to provide a one-piece paperboard insert which may be positioned within a conventional outer shipping container and which is adapted to receive garments arranged on clothes hangers.

Another object of the invention is the provision of garment box insert adapted to receive and retain hook portions of garment hangers containing garments to be packaged.

A more specific object of the invention is the provision of a one-piece collapsible paperboard insert which includes a tray section having at opposite ends thereof a pair of hollow end sections each adapted to receive hook portions of garment hangers.

These and other objects of the invention will be apparent from an examination of the following description and drawings.

It will be understood that, for purposes of clarity, certain elements may have been intentionally omitted from certain views where they are believed to be illustrated to better advantage in other views.

DESCRIPTION OF THE PREFERRED EMBODIMENT

Figure 4:
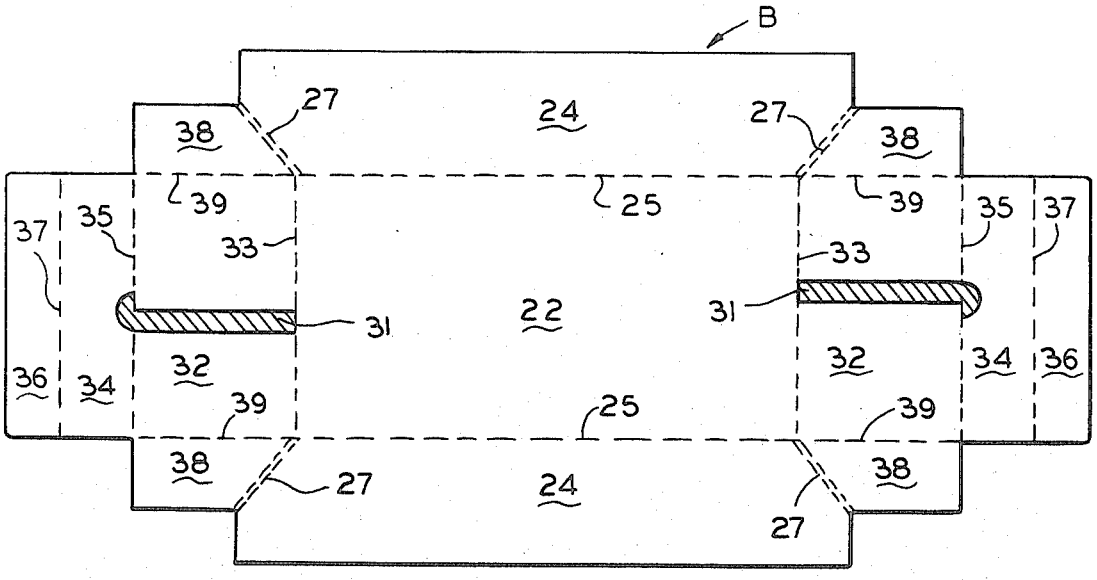
FIG. 4 is a plan view of a blank of foldable sheet material from which the insert illustrated in the other views may be formed.
Figure 1:
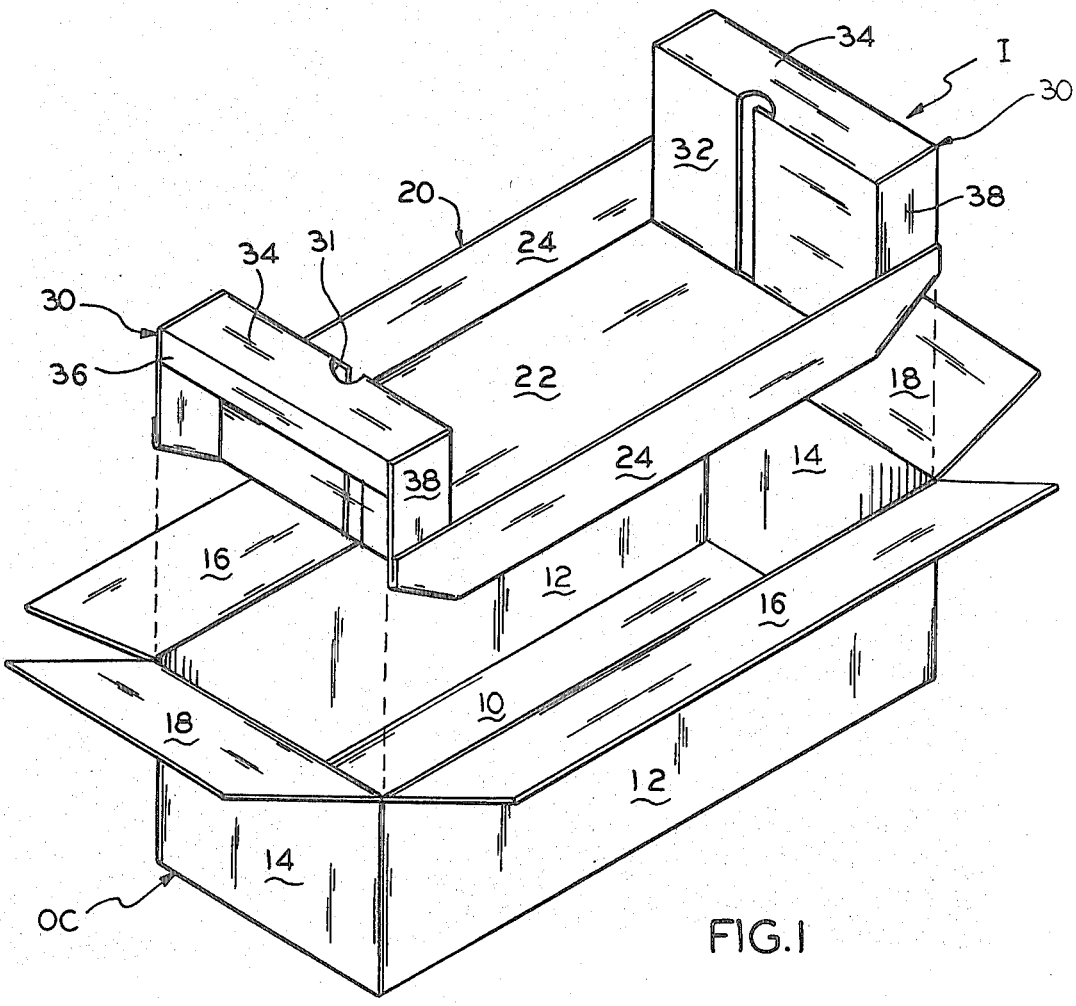
FIG. 1 is an exploded perspective view illustrating an insert embodying features of the invention and a conventional shipping container with which the insert is adapted to be used.
Figure 2:
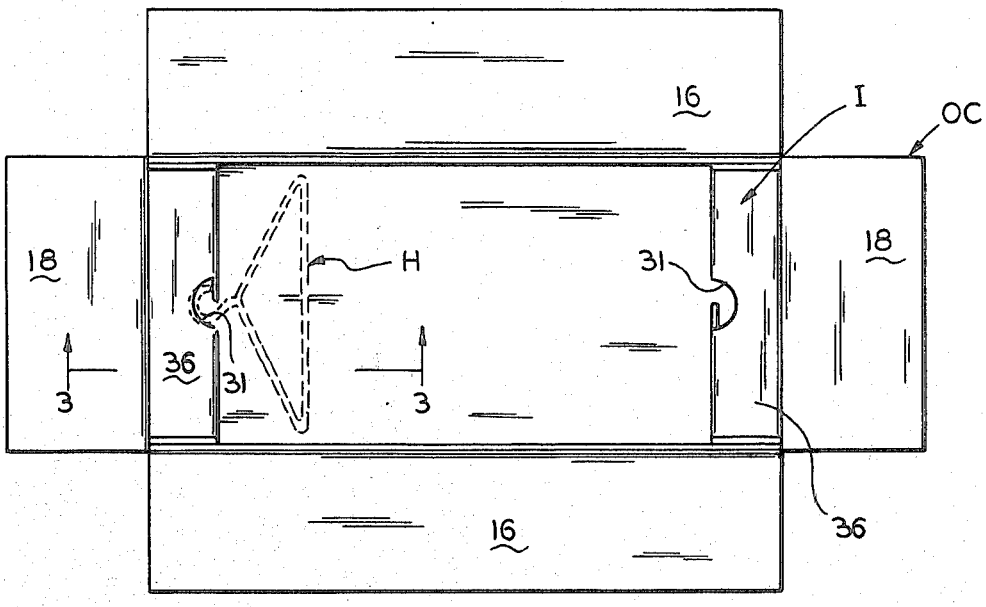
FIG. 2 is a top plan view of an outer shipping container within which has been placed an insert embodying features of the invention.
Figure 3:
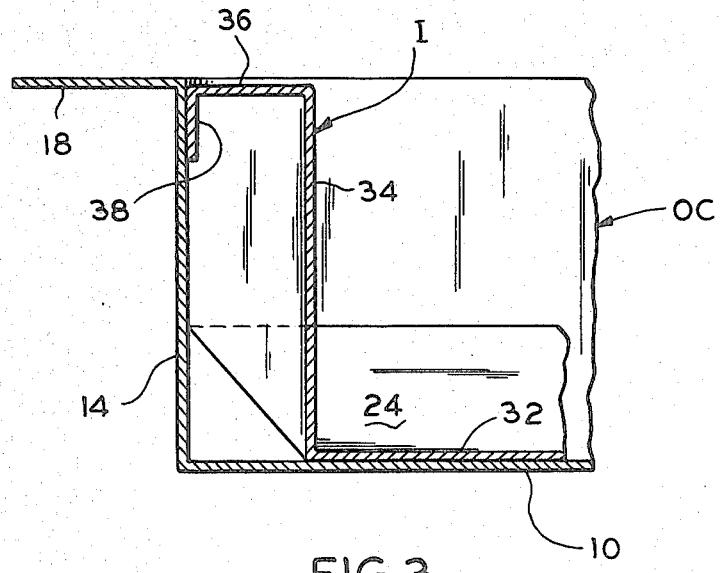
FIG. 3 is a fragmentary longitudinal vertical section taken on line 3—3 of the structure illustrated in FIG. 2.

Referring now to the drawings for a better understanding of the invention, it will be seen that the novel insert, indicated generally at I in FIG. 1, is adapted to be positioned within a conventional shipping container, indicated generally at OC in FIG. 1, and may be formed from the blank B of foldable sheet material, such as paperboard, illustrated in FIG. 4.

As best seen in FIG. 1 the outer shipping container OC may be of a conventional type which includes a bottom wall 10, a pair of opposed side walls 12, a pair of opposed end walls 14, and upper side and end closure flaps 16 and 18, respectively. The exact structure of the outer shipping container is not an essential feature of the present invention.

Referring to FIGS. 1 and 4, it will be seen that the novel garment box insert I embodying features of the invention is a collapsible one-piece structure comprising a pair of hollow end sections 30 adapted to receive the hook portions of garment hangers and a tray-type center section 20 which interconnects end sections 30 and also receives the garments packaged therein.

Center section 20 includes a preferably rectangular bottom wall 22 having a pair of opposed side walls 24 foldably joined at their lower edges on fold lines 25, to opposite side edges thereof and disposed to extend upwardly therefrom to form therewith a tray-like structure.

Each of the end sections 30 is a hollow generally rectangular type structure including an inner panel 32 foldably joined at its lower edge on fold line 33 to a related end edge of bottom wall 22 and disposed to extend upwardly therefrom. End section 30 also includes a top panel 34 which is foldably joined at its inner edge on fold line 35 to the upper edge of inner panel 32. An outer panel or retaining flap 36 is foldably joined at its upper edge on fold line 37 to the rear edge of top panel 34 and is disposed to extend downwardly from panel 34. Each end section also includes a pair of side panels 38 which are foldably joined at their forward edges on fold lines 39 to opposite side edges of inner panel 32 and which are foldably joined along sloping lower edges on diagonal fold lines 27 to corresponding sloping lower edges of related side walls 24 of the center section 20.

Still referring to FIG. 1, it will be seen that the inner and top panels 32 and 34 of each end section 30 include a common slot or opening 31 adapted to receive hook portions of hangers H and maintain them in proper aligned position.

It will be appreciated that the novel insert provides an economical way to have a garment package which does not require the entire container to be specially constructed. The novel insert is adapted to be used within any conventional outer sipping container having appropriate dimensions so that the bottom wall 22 of the insert can be positioned on the bottom wall 10 of the outer container with the side walls 24 and side panels 38 of the insert against the side walls 12 of the outer container and with the end sections 30 of the insert against the end walls 14 of the outer container.

Also it will be understood that, by virtue of the diagonal or sloping fold lines 27 which interconnect the center section side walls 24 to the end section side panels 38, a rigid structure is provided which may be easily erected from a flat blank.

In order to erect the device, as best in FIG. 4, when the end portions of the blank are folded upwardly at right angles to bottom wall 22 and the side panels 38 are folded rearwardly, the side walls 24 will automatically be folded into position. The top panels and rear panels may then be folded back into position and the insert is ready to be positioned within an outer container.

Thus, it will be appreciated that the invention provides a unique design which is relatively inexpensive to manufacture and which may be used with any conventional type outer shipping container to hold a plurality of garments arranged on hangers having hook portions.

What is claimed is:

1. An insert, for use within an outer shipping container having bottom, side, and end walls, for holding a plurality of garments on hangers having hook portions, said insert being formed from a unitary blank of foldable paperboard and comprising:

(a) a pair of hanger receiving end sections interconnected by a center section;

(b) said center section including:

(i) a generally rectangular bottom wall;

(ii) a pair of side walls foldably joined to and upstanding from opposite side edges of said bottom wall;

(c) each of said end sections including:

(i) an inner panel foldably joined at its lower edge to an end edge of said bottom wall and upstanding therefrom;

(ii) a top panel foldably joined at its inner edge to an upper edge of said inner panel and extending outwardly therefrom;

(iii) said inner and top panels having a common opening for receiving hook portions of garment hangers;

(iv) an outer panel foldably joined at its upper edge to an outer edge of said top panel and extending downwardly therefrom;

(v) a pair of side panels foldably joined at their inner edges to adjacent side edges of said inner panels and foldably joined at their lower edges to lower edges of adjacent center section side panels on diagonal fold lines.

2. An insert, for use within an outer shipping container having bottom, side, and end walls, for holding a plurality of garments on hangers having hook portions, said insert being formed from a unitary blank of foldable paperboard and comprising:

(a) a pair of hanger receiving end sections interconnected by a center section having a bottom wall;

(b) each of said end sections including:

(i) an inner panel foldably joined at its lower edge to an edge of said bottom wall and upstanding therefrom;

(ii) a top panel foldably joined at its inner edge to an upper edge of said inner panel and extending outwardly therefrom;

(iii) said inner and top panels having a comon opening for receiving hook portions of garment hangers;

(iv) an outer panel foldably joined at its upper edge to an outer edge of said top panel and extending downwardly therefrom;

(v) a pair of side panels foldably joined at their inner edges to adjacent side edges of said inner panels.

3. An insert, for use within an outer shipping container having bottom, side, and end walls, for holding a plurality of garments on hangers having hook portions, said insert being formed from a unitary blank of foldable paperbord and comprising:

(a) a pair of hanger receiving end sections interconnected by a center section having a bottom wall;

(b) each of said end sections including:

(i) an inner panel foldably joined at its lower edge to an end edge of said bottom wall and upstanding therefrom;

(ii) a top panel foldably joined at its inner edge to an upper edge of said inner panel and extending outwardly therefrom;

(iii) said inner and top panels having a common opening for receiving hook portions of garment hangers;

(iv) an outer panel foldably joined at its upper edge to an outer edge of said top panel and extending downwardly therefrom.

* * * * *